US007835651B2

(12) United States Patent
Tanaka et al.

(10) Patent No.: US 7,835,651 B2
(45) Date of Patent: Nov. 16, 2010

(54) IMAGE FORMING APPARATUS AND IMAGE FORMING METHOD

(75) Inventors: Hiroshi Tanaka, Matsumoto (JP); Yoichi Ito, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 637 days.

(21) Appl. No.: 11/925,458

(22) Filed: Oct. 26, 2007

(65) Prior Publication Data

US 2008/0107442 A1 May 8, 2008

(30) Foreign Application Priority Data

Oct. 27, 2006 (JP) ..... 2006-292414

(51) Int. Cl.
*G03G 15/08* (2006.01)

(52) U.S. Cl. ..... 399/27; 399/227

(58) Field of Classification Search ..... 399/10, 399/12, 25, 27, 28, 223, 227
See application file for complete search history.

(56) References Cited

U.S. PATENT DOCUMENTS 7,660,540 B2 * 2/2010 Tanaka et al. ..... 399/27

FOREIGN PATENT DOCUMENTS

WO WO 03/098356 11/2003

* cited by examiner

*Primary Examiner*—David M Gray
*Assistant Examiner*—Gregory H Curran
(74) *Attorney, Agent, or Firm*—DLA Piper LLP (US)

(57) ABSTRACT

An image forming apparatus includes a development portion holder that is mounted with a plurality of development portions having a memory storing information on the corresponding development portion and that selectively positions the development portions at development positions by holding and moving the mounted development portions; a controller that controls the development portion holder and that performs an image forming process of forming an image using the development portion positions at the development position; and an access unit that access the memory of the development portion positioned at an access position, which is a position at which one of the other development portions mounted on the development portion holder is located, to read and record the information when one of the development portions mounted on the development portion holder is positioned at the development position.

8 Claims, 14 Drawing Sheets

HOME POSITION

IMAGE FORMATION POSITION

DETACHMENT POSITION

FIG. 10

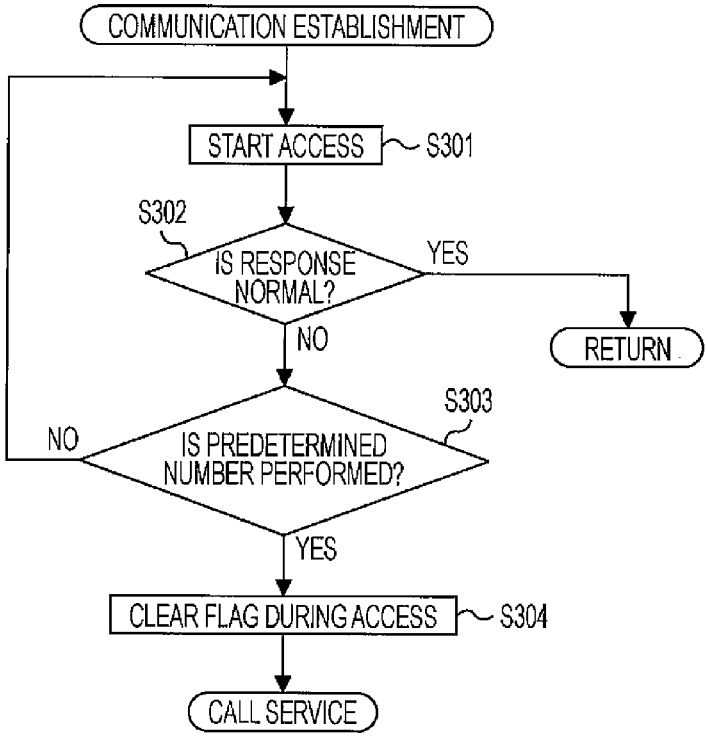

FIG. 11

| BANK NO. | INFORMATION TYPE | DETAILS OF INFORMATION | ACCESS TYPE |
|---|---|---|---|
| 1 | IDENTIFICATION INFORMATION OF DEVELOPMENT UNIT | TONER COLOR MANUFACTURE LOT NO. | R |
| 2 | INFORMATION FOR LIFETIME MANAGEMENT | RESIDUAL QUANTITY OF TONER OPERATION TIME OF DEVELOPMENT ROLLER | R/W |
| 3 | INFORMATION EXCEPT FOR LIFETIME MANAGEMENT | NUMBER OF DETACHMENT BIAS SETTING VALUE | R/W |
| 4 | INFORMATION ON MAIN BODY | NUMBER OF IMAGE FORMATION SHEET TOTAL OPERATION TIME | R/W |

IMAGE FORMING APPARATUS AND IMAGE FORMING METHOD

BACKGROUND

1. Technical Field

The present invention relates to an image forming apparatus and an image forming method of forming an image while switching a plurality of development portions and also reading or writing information to or from memories disposed in the development portions.

2. Related Art

In an image forming apparatus in which a development port holder is mounted with a plurality of development portions and which forms an image by switching the development portions, each of the development portions can include a memory for storing lifetime information thereof. For example, in the image forming apparatus disclosed in WO03/098356 (for example, FIG. 9A), a plurality of development portions are mounted in a rotary unit and rotated so that one of the development portions which is positioned at a position opposite a photosensitive member develops an electrostatic latent image. Each of the development portions is provided with a memory cell for storing information thereof and with a wireless communication antenna. When one of the development portions is positioned at the position opposite the photosensitive member, the antenna is disposed so as to communicate with another antenna mounted in another development portion. In addition, while one of the development portions develops the electrostatic latent image, the antenna thereof communicates with the antennas of the other development portions which do not develop the electrostatic latent image in order to read and write the information.

The inventors have found that, in an apparatus which forms an image by moving and switching development portions, it is desirable to have as long a period of time as possible until the development portion starts to perform a developing process after the development portions are switched in order to improve an image quality. It is considered that the reason for requiring a long period of time is because some time is necessary to obtain stable characteristic.

Accordingly, when the development portions are switched, it is necessary to immediately switch the development portion which finishes the developing process to the next development portion. However, when the development portions are switched quickly in this way, a known image forming apparatus may not appropriately read or write information to or from the development portions. That is because the development portions only stop for a short period of time, and some processing time is necessary for reading or writing information to and from the development portion.

SUMMARY

An advantage of some aspects of the invention is that it provides a technique for appropriately reading or writing information to or from development portions while quickly switching the development portions.

According to an aspect of the invention, there is provided an image forming apparatus including a development portion holder that is mounted with a plurality of development portions, each having a memory storing information thereof and that selectively positions the development portions at a development position by holding and moving the mounted development portions; a controller that controls the development portion holder and that performs an image forming process of forming an image using the development portion positioned at the development position; and an access unit that access the memory of the development portion positioned at an access position, which is a position at which one of the other development portions mounted on the development portion holder is located, to read and record the information when one of the development portions mounted on the development portion holder is positioned at the development position, wherein when the access unit is accessing the memory at the time of an image formation of the development portion positioned at the development position in the image forming process, the controller controls the development portion holder to stop the access and to start the switching of the development portions in a state where a non-end indicator indicating that the access has not ended is recorded, and wherein when the access unit is not accessing the memory, the controller controls the development portion holder to start the switching of the development portions in a state where the non-end indicator is not recorded.

According to another aspect of the invention, there is provided an image forming method of performing an image forming process of selectively positioning a plurality of development portions at a predetermined development position, forming an image by the use of the development portion positioned at the predetermined development position, and accessing a memory of the development portion positioned at an access position other than the development position to read or record information on the development portion, the image forming method including: ending the access and starting the switching of the development portions in a state where a non-end indicator indicating that the access has not ended is recorded, when the access to the memory is being performed at the time of ending an image formation of the development portion positioned at the development position in the image forming process; and starting the switching of the development portions in a state where the non-end indicator is not recorded, when the access to the memory is not being performed.

According to the image forming apparatus with the above-described configuration, at the time of switching the development portions after the end of the image formation, the access is stopped to switch the development portions without waiting the completion of the access of the access unit to the memories. Accordingly, according to the image forming apparatus with the above-described configuration, after the end of the image formation, it is possible to switch the development portions at the quick timing irrespective of whether the access unit ends the access to the memory. Alternatively, when the access is stopped, the non-end indicator indicating the end of the access is recorded. Accordingly, it is possible to reliably identify whether the end of the performing access ends. As a result, even when the access does not end, it is possible to appropriately switch the development portions.

In the image forming apparatus with the above-described configuration, the non-end indicator may be provided to correspond to the plurality of development portions that can be mounted on the development portion holder. With such a configuration, it is possible to separately manage the access status to the memories of the development portions.

For example, the access type of the access unit to the memory may be changed depending on whether the non-end indicator is recorded right before starting the access. What the non-end indicator is recorded right before starting the access means that the previous access to the corresponding development portion does not end. As a result, when the non-end indicator is already recorded right before starting the access, another type of access, which is different from the case where the previous access ends, may be performed to deal with the case where the previous access does not end.

Specifically, for example, the access unit may perform an access process including processes of reading information from the memory and recording information on the memory when the non-end indicator is not recorded right before starting the access, and perform an access process not including a process of reading information from the memory but including a process of recording information on the memory when the non-end indicator is recorded right before starting the access. That the previous access process does not end means as follows: the reliability of the information stored in the memory may be damaged. Accordingly, when the non-end indicator is recorded, the reading process may be not performed on the assumption that the read information has no reliability. Alternatively, the reading process may not be used afterward even though the reading process is performed.

In the image forming apparatus with the above-described configuration, the controller may change a process type based on the information read from the memory, depending on whether the non-end indicator is recorded right before the access unit starts the access to the memory. Depending on whether the previous access ends or not from the same viewpoint, the reliability of the information stored in the memory considerably varies. Accordingly, when the process is performed on the basis on the information read from the memory, the process type may be changed.

Specifically, for example, the information stored in the memory may include variation information that varies with the use of the corresponding development portion, the controller may include an information holder that temporarily holds at least a part of the variation information recorded in the memory by the access unit, and the controller may judge the identification of the development portion by comparing the variation information read from the memory and the variation information held in the information holder when the non-end indicator is not recorded right before starting the access of the access unit, and does not judge the identification based on the variation information when the non-end indicator is recorded.

The variation information that varies with the use of the corresponding development portion is an evident clue for determining the identification of the development portion to be previously accessed and the identification of the development portion to be accessed afterward. That is, if there in no abnormality in the image forming apparatus, the information read from the memory in the present access will be identical with the information recorded on the memory in the previous access. However, when the previous access does not end, the above-described case is not necessarily effective. Accordingly, there is a possibility that an erroneous result results from the determination of the identification of the development portions based on the comparison of the variation information. In this case, the identification of the development portions based on the comparison of the variation information is not determined in order to prevent the erroneous determination on the basis of the wrong information.

Since the information to be not recorded in the stopped access is considered to keep the reliability, the determination based on such information can be performed without a problem. For example, the information such as a manufacture lot No., toner colors, or the like of the development portions is recorded at the time of manufacturing the development portions. In addition, the information may be not changed afterward. Accordingly, it is considered that the information may not be deteriorated due to the stop of the access.

For example, in the image forming apparatus with the above-described configuration, the non-end indicator may be a flag that is set at the time of starting the accessing of the access unit to the memory and that is cleared at the time of ending the access. The flag is in the set state during the accessing of the access unit to the memory and after the stop of the access. In addition, the flag is initially cleared after the end of the access. Whether the accessing of the access unit to the memory is in progress can be judged naturally by the image forming apparatus. Accordingly, even when the accessing is not performed, but the corresponding flag is set, the previous accessing is considered not to end. That is, such a flag can be used as the non-end indicator. The value of the flag may be kept even when the image forming apparatus turns off.

BRIEF DESCRIPTION OF THE DRAWINGS

The invention will be described with reference to the accompanying drawings, wherein like numbers reference like elements.

FIG. 10 is a flowchart illustrating a communication establishment process.

FIG. 11 is a diagram illustrating a memory map showing information contents of a memory chip.

DESCRIPTION OF EXEMPLARY EMBODIMENTS

Figure 1:
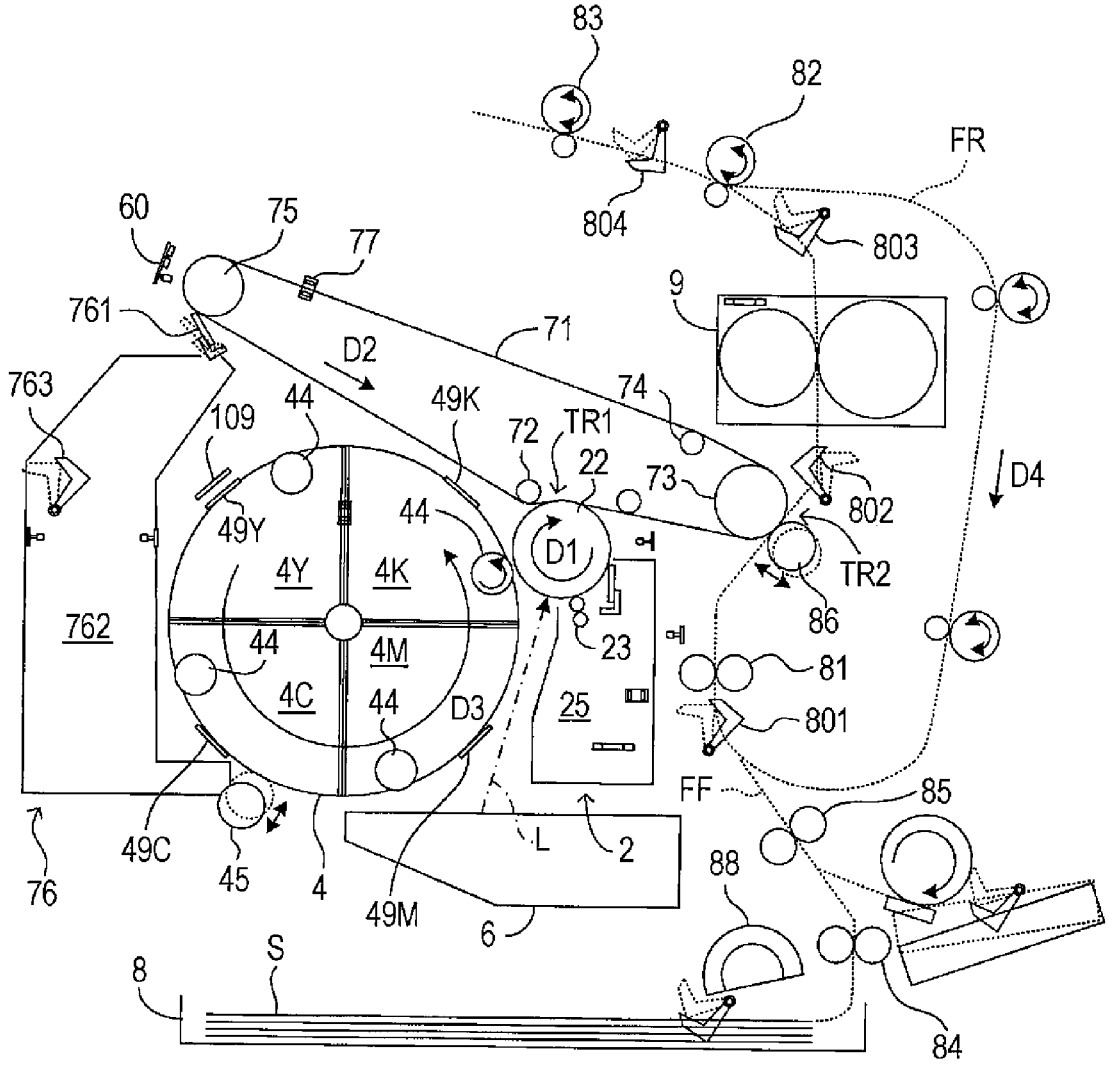
FIG. 1 is a diagram illustrating an image forming apparatus according to an embodiment of the invention.
Figure 2:
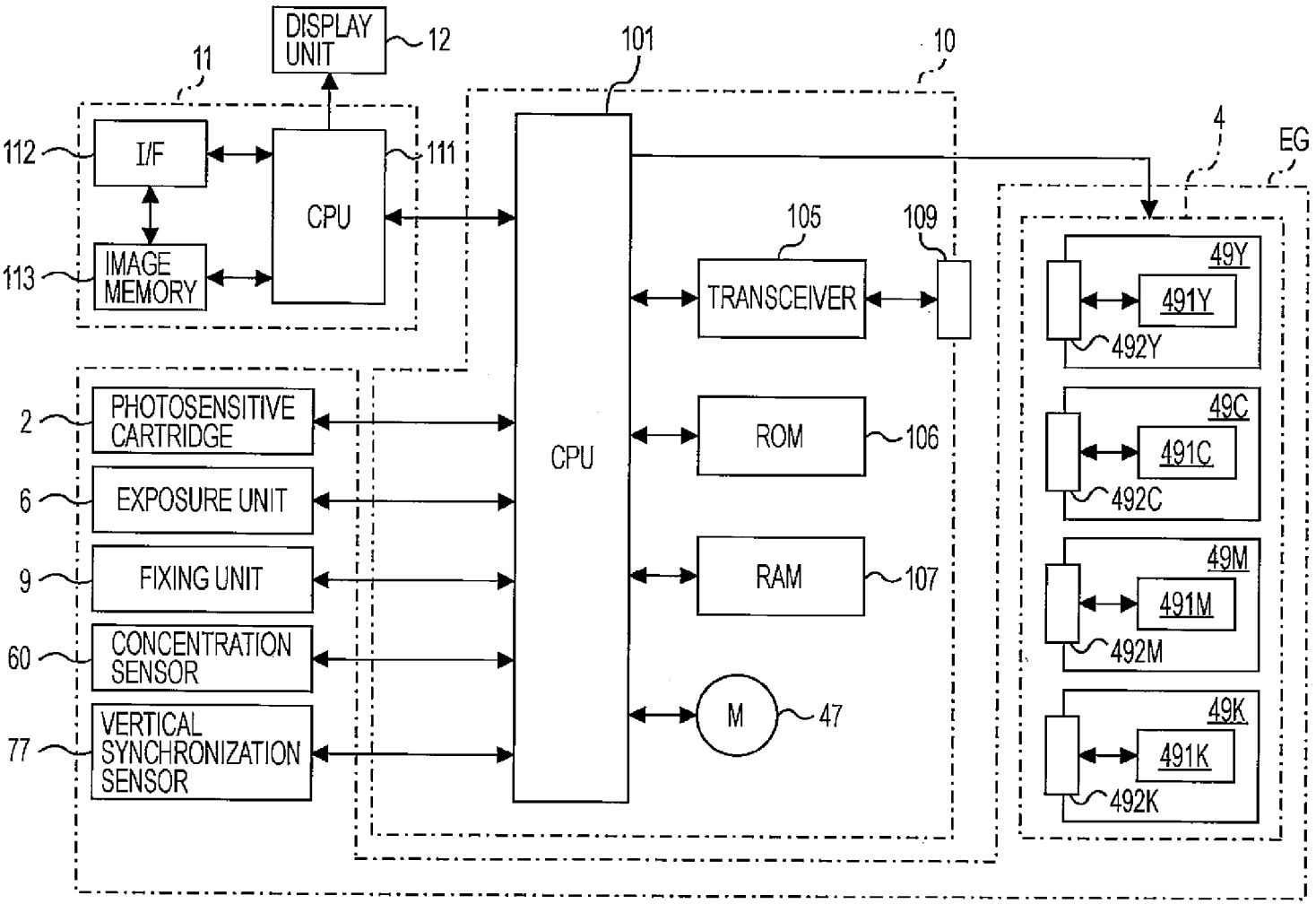
FIG. 2 is a block diagram illustrating an electrical configuration of the image forming apparatus shown in FIG. 1.

FIG. 1 is a diagram illustrating an image forming apparatus according to an embodiment of the invention. FIG. 2 is a block diagram illustrating an electrical configuration of the image forming apparatus shown in FIG. 1. The image forming apparatus forms a full color image by overlapping four-color toners (developer) of yellow (Y), cyan (C), magenta (M), and black (K) or forms a black-and-white image using a black toner of black (K). When an image signal is transmitted from an exterior apparatus such as a host computer to a main controller 11, a CPU 101 disposed in an engine controller 10 controls each unit of an engine EG according to an instruction of the main controller 11 to perform a predetermined image forming process and the image forming apparatus forms an image corresponding to the image signal on a sheet S.

In the engine EG, a photosensitive member 22 is rotatably provided in an arrow rotation direction D1 shown in FIG. 1. An electric charge roller 23, a rotary development unit 4, and a cleaning portion 25 are disposed in the vicinity of the photosensitive member 22 along the rotation direction D1. Since a predetermined electric charge bias is applied, the electric charge roller 23 electrifies an outer peripheral surface of the photosensitive member 22 with a predetermined surface potential. The cleaning portion 25 removes toner remaining on a surface of the photosensitive member 22 after a first transcription and recovers the toner into a recovered toner tank disposed inside. The photosensitive member 22, the electric charge roller 23, and the cleaning portion 25 are incorporated with a photosensitive member cartridge 2. The photosensitive member cartridge 2 can be attached to or detached from an apparatus main body.

Optical beams L are emitted from an exposure unit 6 toward the outer peripheral surface of the photosensitive member 22 electrified by the electric charge roller 23. The exposure unit 6 exposes the optical beams L on the photosensitive member 22 in accordance with the image signal transmitted from the exterior apparatus to form an electrostatic latent image corresponding to the image signal.

The electrostatic latent image formed in this manner is developed with toner by the development unit 4. In the image forming apparatus, the development unit 4 includes a support frame 40 rotatably provided on a rotation axis perpendicular to a sheet surface in FIG. 1. The development unit 4 includes a development portion 4Y for a yellow color, a development portion 4C for a cyan color, a development portion 4M for a magenta color, and a development portion 4K for a black color which are detachably mounted on the support frame 40 and each development portion has a nonmagnetic monocomponent toner of a corresponding color. The development unit 4 is rotatably driven in an arrow direction D3 by a development unit driving motor 47 which is a stepping motor controlled by the engine controller 10. In addition, a rotary lock 45 which comes in contact with or breaks contact with the development unit 4 is provided in the apparatus main body. Whenever necessary, the rotary lock 45 serves as a break or a lock mechanism that allows the development unit 4 to be positioned at a predetermined position, which is a stationary position, by coming in contact with the periphery of the support frame 40 of the development unit 4 to stop the rotation of the development unit 4.

When the development unit 4 is rotatably driven in accordance with the control instruction of the engine controller 10 and the development portions 4Y, 4C, 4M, and 4K are selectively positioned at a development position opposite the photosensitive member 22, development rollers 44 which are disposed in the development portions and provide selected color toners are each opposed to the photosensitive member 22 so as to be separated by a predetermined gap. In addition, toners are deposited on a surface of the photosensitive member 22 from the development rollers 44. In this way, an electrostatic latent image on the photosensitive member 22 is developed in the selected toner color.

A toner image developed on the development unit 4 in the above-described manner is transferred from a first transfer region TR1 onto an intermediate transfer belt 71 of a transfer unit 7. The transfer unit 7 includes the intermediate transfer belt 71 suspended on a plurality of rollers 72 to 75 and a driving mechanism (not shown) rotating the intermediate transfer belt 71 in a predetermined rotation direction D2 by rotatably driving the roller 73. In a case of transferring a color image onto a sheet S, the color image is formed by superimposing the toner images of the colors formed on the photosensitive member 22 onto the intermediate transfer belt 71 and the color image is transferred a second time onto the sheet S transported from a cassette 8 to a second transfer region TR2 along a transport passage FF.

The second transfer region TR2 is a nip region which comes in contact with a surface of the intermediate transfer belt 71 suspended on the roller 73 and a second transfer roller 86 coming in contact with and breaking contact with the belt surface. The sheets S that are stacked in the cassette 8 are taken out one by one by rotation of a pick-up roller 88, and then loaded on the transfer passage FF. Subsequently, the taken out sheet S is transported to the second transfer region TR2 along the transport passage FF by rotation of feed rollers 84 and 85 and gate rollers 81.

It is required to control the timing when the sheet S is transported to the second transfer region TR2 in order to appropriately transfer the image on the intermediate transfer belt 71 onto a predetermined area of the sheet S. Specifically, the gate rollers 81 are disposed in front of the second transfer region TR2 and a front-side gate sheet detecting sensor 801 is also disposed in front of the second transfer region TR2 on the transfer passage FF. Subsequently, when the sheet S transported along the transport passage FF is detected by the front-side gate sheet detecting sensor 801, the transporting of the sheet S is stopped for a while and the sheet S is synchronized with the timing of a circular movement of the intermediate transfer belt 71 to resume the rotation of the gate roller 81. So, the sheet S is transported to the second transfer region TR2 at a predetermined timing. In this way, the toner image formed on the intermediate transfer belt 71 is transferred onto a surface of the sheet S passing through the second transfer region TR2.

The toner image is fixed on the sheet S on which the color image is formed in this way by a fixing unit 9, and then is transported to a discharging tray unit 89 disposed in the top portion of the apparatus main body via a front-side discharging roller 82 and a discharging roller 83. In addition, in the case of forming images on both surfaces of the sheets S, a rear end of the sheet S in which the image is formed on one surface in the above-described manner is transported to a reverse position in the rear of the front-side discharging roller 82. At this time, the sheet S is transported in an arrow direction D4 along a reverse transport passage RF by reversing the rotation direction of the discharging roller 83. Subsequently, the sheet S is loaded on the transport passage again before the gate roller 81. However, the surface of the sheet S which comes in contact with the intermediate transfer belt 71 and onto which the image is transferred is the surface opposite the surface on which the image was transferred beforehand. In this way, it is possible to form the image on both surfaces of the sheet S.

In addition to the front-side gate sheet detecting sensor 801, sheet detecting sensors 802 to 804 for detecting whether the sheet S passes through the transport passages are disposed on the sheet transport passage FF and the reverse transport passage RF. In addition, on the basis of outputs of the above-described sensors, it is possible to control the sheet transport timing and to detect jamming of the sheet S.

A cleaner 76 is disposed in the vicinity of the roller 75. The cleaner 76 includes a cleaner blade 761 which can be moved close to or separated from the roller 75 by an electromagnetic clutch (not shown) and a waste tank 762. The cleaner blade 761 which moves close to the roller 75 comes in contact with the surface of the intermediate transfer belt 71 suspended on the roller 75 in order to remove the toner remaining on the outer peripheral surface of the intermediate transfer belt 71 after the second transferring process. The removed toner is deposited in the waste tank 762. The waste tank 762 includes a waste sensor 763 which can detect whether the waste tank 762 is full of the toner.

When the image is transferred onto the sheet S in the second transfer region TR2, the cleaner blade 761 comes in contact with or breaks contact with the intermediate transfer belt 71 in order to remove the toner remaining on the intermediate transfer belt 71 at the same circular time. For example, when a black and white image is successively formed, the image transferred onto the intermediate transfer belt 71 in the first transfer region TR1 is immediately transferred onto the sheet S in the second transfer region TR2. Accordingly, the cleaner blade 761 continues to come in contact with the intermediate transfer belt 71. Alternatively, in a case of forming a color image, it is required that the cleaner blade 761 breaks contact with the intermediate transfer belt 71 while superimposing the toner images of the colors. Subsequently, when finishing the full color image by superimposing the toner images of the colors, the cleaner blade 761 comes in contact with the intermediate transfer belt 71 in order to remove the remaining toner at the same time as the second transferring.

A concentration sensor 60 and a vertical synchronization sensor 77 are disposed in the vicinity of the roller 75. The concentration sensor 60 is disposed so as to be opposed to the surface of the intermediate transfer belt 71. If necessary, the concentration sensor 60 measures an image concentration of the toner image formed on the outer peripheral surface of the intermediate transfer belt 71. In addition, on the basis of the measurement result, the image forming apparatus adjusts operational conditions which have an effect on image quality. Examples of the operation conditions include a development bias applied to each of the development portions and a magnitude of the optical beams L. The concentration sensor 60 is configured to output a signal corresponding to an image concentration on a predetermined area of the intermediate transfer belt 71 using, for example, a reflective photosensor. Moreover, a CPU 101 can detect the image concentration of all the parts of the toner image on the intermediate transfer belt 71 by periodically sampling the output signal from the concentration sensor 60 while rotating the intermediate transfer belt 71.

The vertical synchronization sensor 77, which is a sensor for detecting a reference position of the intermediate transfer belt 71, can also serve as a sensor for obtaining a synchronization signal output in relation to the rotational drive of the intermediate transfer belt 71, that is, a vertical synchronization signal Vsync. In addition, the apparatus controls the operation of each unit on the basis of the vertical synchronization signal Vsync in order to synchronize the operational timing of each unit and exactly superimpose the toner images formed with the colors.

Memory tags 49Y, 49C, 49M, and 49K are attached to the peripheral surfaces corresponding to the development portions 4Y, 4C, 4M, and 4K of the development unit 4 which has a substantially cylindrical shape. For example, the memory tag 49Y mounted in the yellow development portion 4Y includes a memory chip 491Y storing a manufacture lot number or a use history of the development portion 4Y and data on the amount of toner remaining, and the like and a loop antenna 492Y electrically connected to the memory 491Y. In addition, memory chips 491C, 491M, and 491K and loop antennas 492C, 492M, and 492K are mounted in the memory tags 49C, 49M, and 49K of the other development portions, respectively.

A wireless communication antenna 109 is disposed in the apparatus main body. The wireless communication antenna 109, which is driven by a transceiver 105 connected to the CPU 101, allows data to be transmitted and received between the memories mounted in the CPU 101 and the development portions as wireless communication antennas of the development portions perform wireless communication. At this time, management for various types of information such as management of consumables for the development portions is performed.

As shown in FIG. 2, the image forming apparatus includes a display unit 12 controlled by a CPU 111 of a main controller 11. The display unit 12, which is configured by, for example, a liquid crystal display, displays a predetermined operation guide for a user, a process status of the image forming process, an error of the apparatus, required exchange any unit, or the like on the basis of the control instruction of the CPU 111.

As shown in FIG. 2, an image memory 113 which stores images transmitted from an external device via an interface 112 is provided in the main controller 11. A ROM 106 stores a calculation program executed by the CPU 101 or control data for controlling the engine EG. A RAM 107 temporarily stores calculation results of the CPU 101 or other data.

Figure 3A:
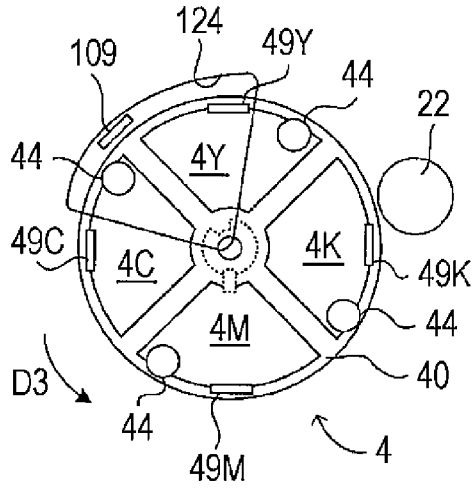
FIGS. 3A to 3C are schematic diagrams illustrating a stationary position of a development unit.
Figure 3B:
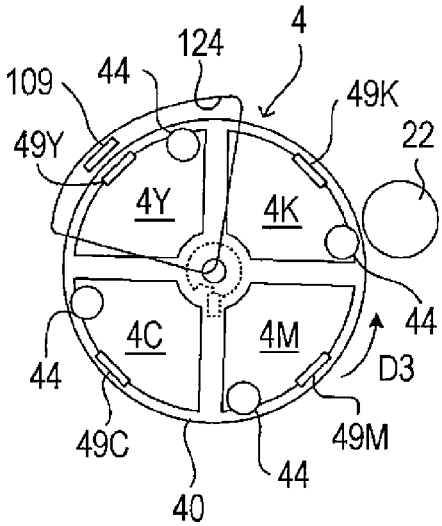
Figure 3C:
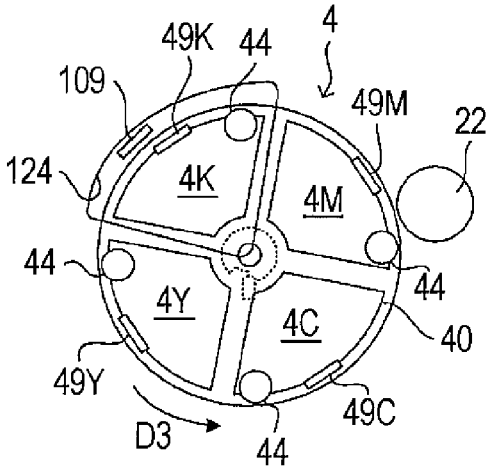

FIGS. 3A to 3C are schematic diagrams illustrating a stationary position of the development unit 4. The development unit 4 can be placed and fixed at 3 positions shown in FIGS. 3A to 3C by the development unit driving motor 47 and the rotary lock 45. The 3 positions refer to a home position, an image formation position, and a detachment position. The home position is a position in which the development unit 4 is placed when the image forming apparatus does not perform image forming process. As shown in FIG. 3A, the development rollers 44 disposed in the development portion 4Y are separated from the photosensitive member 22.

The image formation position is a position in which each of the development portions are positioned when the electrostatic latent image of the photosensitive member 22 is developed to selected toner color. As shown in FIG. 3B, the development roller 44 (in FIG. 3B, the development roller 44 provided in the black development portion 4K) mounted in one development portion is opposed to the photosensitive member 22. As a predetermined development bias is applied, the electrostatic latent image is developed with the toner. In the embodiments, when the development unit 4 is in the image formation position, a position of the development portion (in FIG. 3B, the black development portion 4K) of which the development roller 44 is opposed to the photosensitive member 22 refers to "a development position".

In addition, the detachment position is a position used only when each of the development portions is attached or detached. When the development unit 4 is in the detachment position, as shown in FIG. 3C, one development portion is moved to an opening 124 formed on a side surface of an outer chassis of the image forming apparatus so as to be taken out. FIG. 3*c* shows that the black development portion 4K is moved to the opening 124. Moreover, a new development portion can be mounted in the support frame 40 in which the development portion is not mounted. When the development unit 4 is in the detachment position, all the development rollers 44 mounted in the development portions are separated from the photosensitive member 22. In this way, when the development unit 4 is in the detachment position, it is possible to take out only one development portion moved to the opening 124. That is, when the development unit 4 is in the home position shown in FIG. 3A or the image formation position shown in FIG. 3B, it is not possible to take out any development portion. Accordingly, a user cannot damage the image formation apparatus by attaching or detaching the development portions carelessly. In addition, in the image forming apparatus, the above-described image formation position and the detachment position are configured in each of the four development portions 4Y, 4M, 4C, and 4K.

When the development unit 4 is positioned at the development position, as shown in FIG. 3B, the wireless communication antenna disposed in one development portion is placed so as to be opposed to the wireless communication antenna 109 of the apparatus main body. In FIG. 3B, when the development roller 44 of the development portion 4K is opposed to the photosensitive member 22, the wireless communication antenna 492Y disposed in the development portions 4Y positioned in a downstream-side adjacent position in the rotation direction D3 of the development unit 4 in view of the development portion 4K is placed so as to be opposed to the wireless communication antenna 109 of the apparatus main body. At this time, the wireless communication antenna 109 of the apparatus main body communicates with the wireless communication antenna 492Y in order to read the information stored in the memory 491Y disposed in the development portions 4Y. In addition, new information is stored in the memory 491Y. The position of each of the development portions when the antenna of the development portions is opposed to the antenna 109 of the apparatus main body refers to "an access position". That is, in FIG. 3B, the yellow development portion 4Y is positioned at the access position.

In the image forming apparatus having the above-described configuration, it is possible to perform image formation in a color image formation mode in which an image is formed by using the four development portions 4Y, 4M, 4C, and 4K and a black-and-white image formation mode in which an image is formed by using, for example, only the black development portion 4K. In addition, in each mode, there are an operation mode (one-image formation operation) in which one image is formed and an operation mode (two-image formation process) in which two images are successively formed while the intermediate transfer belt 71 rotates once. When several images are successively formed, the two-image formation process in which throughput is higher is generally selected to perform the image formation process. Alternatively, when only one image is formed or when a size of an image to be formed is large and so two images cannot be formed in a line on the intermediate transfer belt 71, the one-image formation operation is selected.

Figure 4:
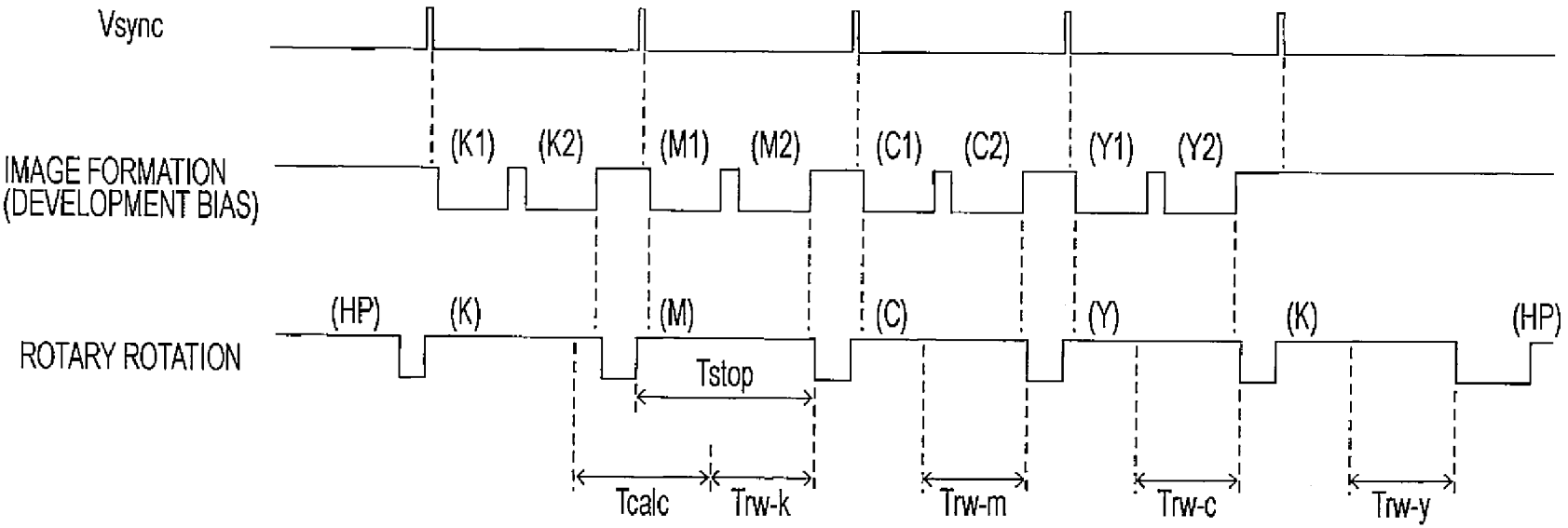
FIG. 4 is a timing chart illustrating a two-image formation process of a color image formation mode.

FIG. 4 is a timing chart illustrating a two-image formation process of a color image formation mode. As the simplest case, a case where the number of images to be formed is 2 is exemplified. The development bias and a rotary rotation shown in FIG. 4 are described by a negative logic, and thus an L level indicates an ON state. In this case, whenever the intermediate transfer belt 71 rotates once, the development bias is applied to the roller 44 in the development position twice per one period of the vertical synchronization signal Vsync output by one pulse from the vertical synchronization sensor 77. At this time, two toner images of mono-color are formed. In FIG. 4, the reference numerals K1 and K2 indicate one image and two images of the black color. The same is applied to the magenta (M) color, the cyan (C) color, and the yellow (Y) color.

The rotary development unit 4 moves a black (K) development portion 4K from a home position HP to the development position. Whenever the intermediate transfer belt 71 rotates once, the rotary development unit 4 rotates every 90° so as to sequentially position the magenta (M) development portion 4M, the cyan (C) development portion 4C, and the yellow (Y) development portion 4Y at the development position. In the embodiment, the above-described process refers to "a switch of the development portions". With respect to maintaining one of the development portions at the development position, the period of time the development unit 4 remains stationary is referred to as a stationary time Tstop.

When the development portions are switched, the development portions in the corresponding development position move to the corresponding access position in which it is possible to communicate with the wireless communication antenna 109 of the apparatus main body. In this way, while performing the image forming process using the development portions in the corresponding development position, it is possible to access the memories of the development portions in the corresponding access position. In the image forming apparatus, lifetime management of the development portions is performed on the basis of the information on the use status of the development portions stored in the memory chips of the development portions. For example, the lifetime management of the development portions is carried out in a manner in which the stored toner residual amount of each of the development portions is updated by calculating the amount of toner consumed to form an image from the image data and writing a value obtained by subtracting the amount of consumed toner from the toner quantity stored in each of the memory chips of the development portions. Since the amount of remaining toner is also stored in the RAM 107 of the engine controller 10, reading or writing to or from the memory chips may not be necessarily performed every time the amount of remaining toner is calculated. However, in order to prevent the latest toner residual quantity from not being stored in each of the development portions when each of the development portions is taken out, in the embodiment, the image forming apparatus accesses the memory chips every time the image is formed and updates the information on the use status of the development portions changed by using the toner.

When all the image data required to form the two black toner images R1 and K2 are given in a case where the development portion 4K forms the black toner image, the CPU 101 starts calculation of an amount of toner required to form the toner images. The time necessary for the calculation is referred to as Tcalc. The update of the amount of remaining toner can be performed when the development portion 4K stays at the access position and the calculation of the amount of remaining toner is finished. Time Trw-k until the development unit 4 starts rotation after finishing the calculation is a period of time when the memory access process of the black development portion 4K can be performed. The time refers to "an accessible period of time" to the black development portion 4K. Likewise, time when the memory access process to the magenta development portion 4M, the cyan development portion 4C, and the yellow development portion 4Y can be performed refers to Trw-m, Trw-c, and Trw-t, respectively.

In the normal image forming process, the process sequence is configured so as to make the accessible time longer than the time required to perform the memory access. Accordingly, in the process mode, whenever the image formation process ends, the amount of remaining toner stored in the memory chip of the used development portion can be updated. The update can be performed along with the image formation of the next development portion. However, when the last used yellow development portion 4Y is used, the development portion used to form the image does not exist. Accordingly, after the end of the image formation, the development unit 4 rotates by 90° additionally, so as to access the memory of the yellow development portion 4Y, and then returns the development unit 4 to the home position.

Figure 5:
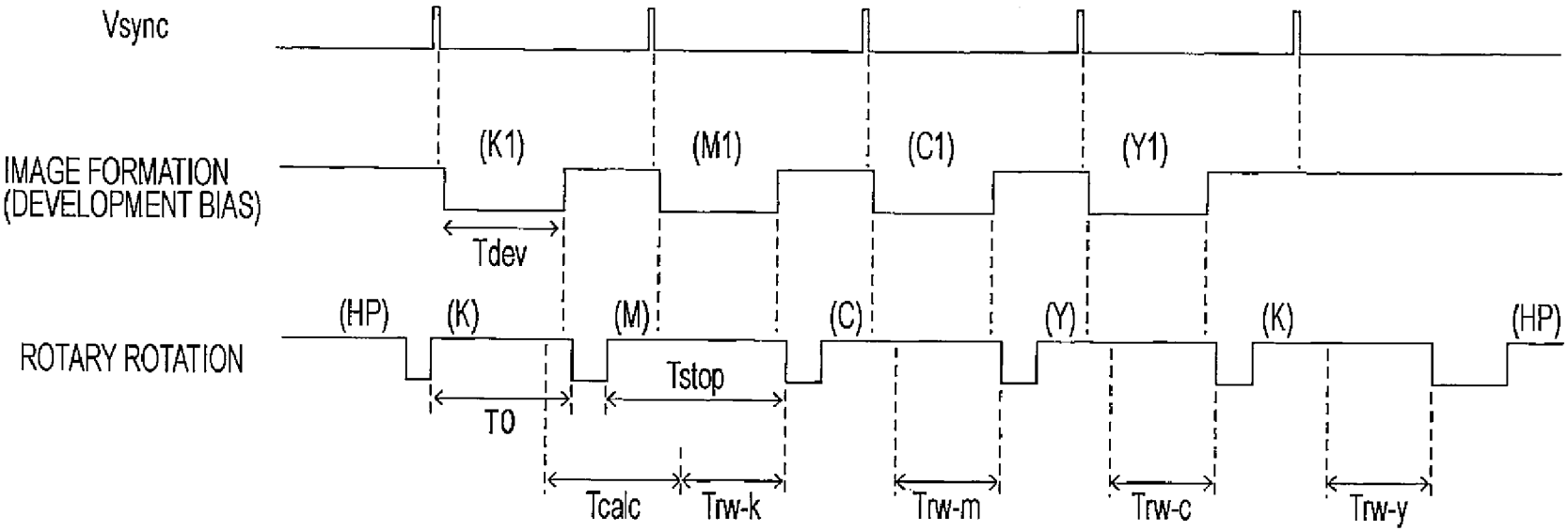
FIG. 5 is a timing chart illustrating a one-image formation process of the color image formation mode.

FIG. 5 is a timing chart illustrating a one-image formation process of the color image formation mode. In the process mode, one toner image is formed while the intermediate transfer belt 71 rotates once. The process mode is performed when only one image is formed, a size of the image to be formed is so big that two images cannot be formed on the intermediate transfer belt 71 in a line, or other cases. In the process, a period of time Tdev when the development bias is applied is set in accordance with a size of the image to be formed.

In the image forming apparatus, the development portions are switched immediately when the image formation is performed by one of the development portions. That is, when the application of the development bias to the development portions at the development position ends, the development unit 4 immediately starts the rotation. The rotation is performed in accordance with the request for an image quality. That is, in the image formation apparatus forming an image while switching the development portions, when one of the development portions finishes the image formation, the next development portion is moved to the development position, the development bias is applied, and then the electrostatic latent image is developed by the applied development bias. At this time, since it takes time until the rotation of the development rollers 44 or a voltage of bias are stabilized, an initial image quality may be not stable. In order to avoid the problem, it is desirable that the development portions are moved to the development position as soon as possible, and then the rotation of the development rollers 44 and the application of the development bias start. In the image forming apparatus, the development unit 4 starts the rotation as soon as possible after the end of the development, and more specifically, after end of the application of the development bias.

Figure 6:
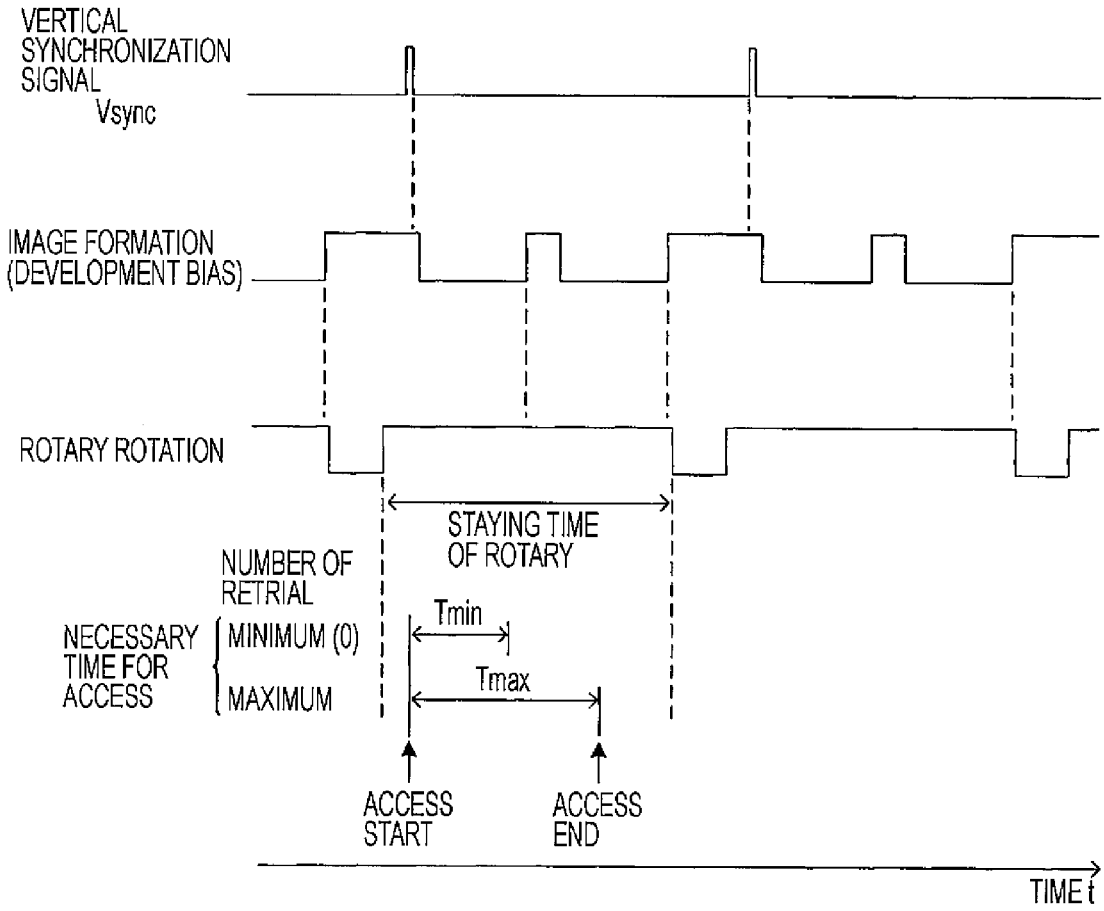
FIG. 6 is a diagram illustrating one example of relation between stationary time and necessary access time of the development unit.

Time T0 when the initially used black development portion 4K stays at the development position varies in correspondence to the application time Tdev of the development bias. For example, when the application time Tdev of the development bias to the black development portion 4K is relatively short, as shown in FIG. 6, the time T0 when the black development portion 4K stays at the development position may be shorter than the time Tstop when another development portion stays at the development position. Afterward, since the switch is performed when the intermediate transfer belt 71 rotates once, the stationary time Tstop of another development portion is the same as that of the two-image formation process.

In this way, when the rotation of the development unit 4 starts as soon as possible after the end of the development, the stationary time of the development unit 4 in the image formation process is not necessarily uniform. As a result, the time when the development portions stop at the development position is not also uniform.

Meanwhile, in the embodiment, an access from the transceiver 105 through the wireless communication antenna 109 when the development portions stop at the access position is configured to retry (re-perform) a predetermined number of times if the access fails as described below. Accordingly, time required from the access start to the access termination (hereinafter, referred to as "necessary access time") varies depending on whether the retry is performed in the corresponding access.

Figure 7:
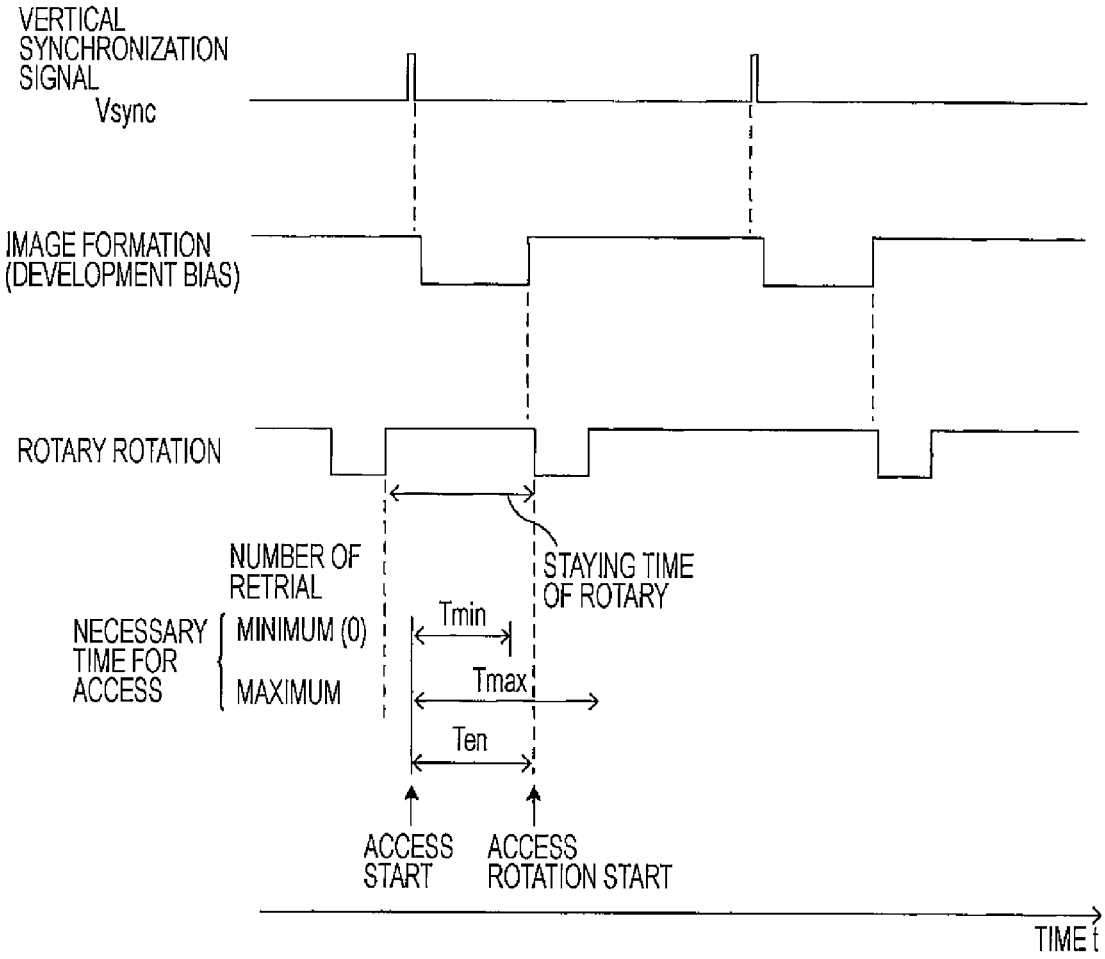
FIG. 7 is a diagram illustrating another example of the relation between the stationary time and the necessary access time of the development unit.

FIGS. 6 and 7 are diagrams illustrating examples of relation between stationary time and the necessary access time of the development unit. In the above-described two-image formation process, as shown in FIG. 6, a rotary stationary time when the rotary development unit 4 stays is relatively long. Meanwhile, the necessary access time required to perform the access to the development portions at the access position varies from a minimum value Tmin, when the access is performed without the retry, to a maximum value Tmax, when the access is performed in consideration of the maximum allowable number of the retries. Even when the maximum retry is performed in a case where the rotary stationary time is long, it is possible to finish the access before the start of the rotary rotation. In other words, the allowable number of retries is determined so as to finish the access before the start of the rotary rotation.

For example, since the rotary stationary time is short, as shown in FIG. 7, the accessible time when the access to the memory is practically possible, that is, time Ten until the development unit 4 starts the rotation after calculation of an amount of consumed toner ends can be smaller than the maximum value Tmax of the necessary access time. In this case, the development unit 4 may start the rotation before the access to the memory ends in accordance with the retry number of times. Moreover, even when the retry is not performed at all in a case where the accessible time Ten is smaller than the minimum value Tmin of the necessary access time, the access cannot be finished. If the access is not finished, the reliability of the information stored in the memory chip of the development portions may be damaged, thereby damaging the lifetime management. In order to avoid such a circumstance, in the embodiment, the CPU 101 performs the image formation process including the access to the memory chip in accordance with the following processing flow.

Figure 8:
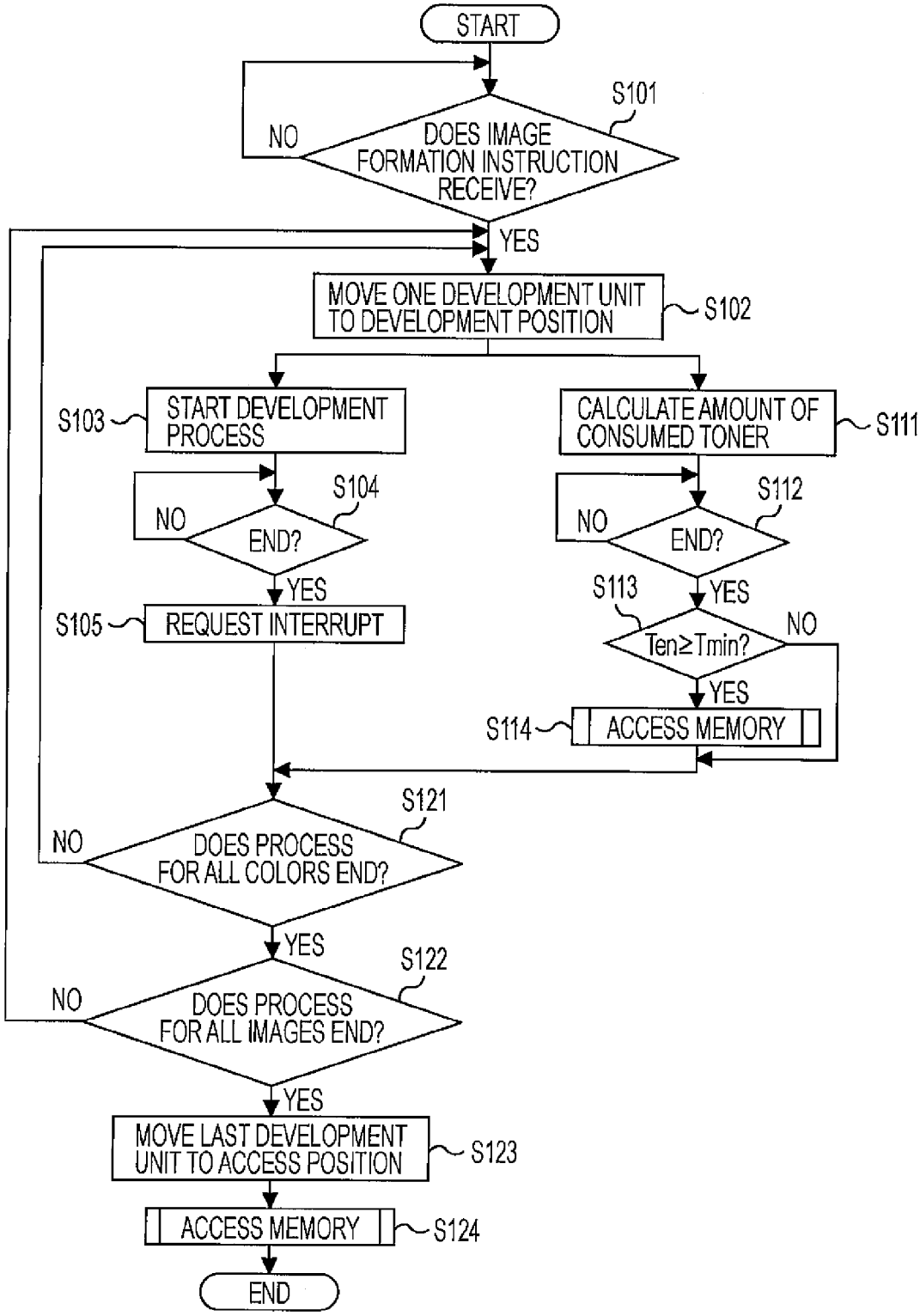
FIG. 8 is a flowchart illustrating an image formation process according to the embodiment.

FIG. 8 is a flowchart illustrating the image formation process according to the embodiment. A formation of the electrostatic latent image and a process of forming the toner image by the development are known and the overview thereof is described above. Accordingly, hereinafter, the detail description of processes except for the development process will be omitted unless the invention is related.

When receiving an image formation instruction from a user, a host computer, or the like (Step S101), the image formation process is started. First, one development portion is positioned at the development position by rotating the development unit 4 (Step S102), and then the development process is started by applying a predetermined development bias to the development portions (Step S103). In this case, the development process is performed in an order of the black development portion 4K, the magenta development portion 4M, the cyan development portion 4C, and the yellow development 4Y in accordance with a positional relation in the development unit 4. However, the invention is not limited thereto.

An amount of toner consumed by the development portions in order to form an image is calculated on the basis of the image data representing a content of the image to be formed (Step S111). At this time, the amount of consumed toner to be calculated does not belong to the development portion which is in the development position now and used in the present development process, but belongs to the development portion which is in the development position beforehand and in the access position now. That is because it is practically not possible to calculate the amount of consumed toner at the same time of performing the development process since the amount of consumed toner cannot be calculated unless all the image data is received. Moreover, the access to the memory chips of the development portions used in the present development process is performed after the corresponding development portion is moved to the access position, and at the present time, it is not necessary to complete the calculation of the amount of consumed toner.

Furthermore, only when the image formation process is just started and a first development portion is in the development position, it is not necessary to perform the memory access to the development portion which is in the access position at such a time. That is because the development portion is not yet used. Accordingly, it is not necessary to perform the memory access to the development portion initially positioned at the access position. In addition, a variation quantity of information which varies in accordance with the use like the amount of consumed toner may be set to zero to perform the access like other cases.

When the calculation of the amount of consumed toner ends (Step S112), the accessible time Ten until the rotation of the development unit 4 starts is compared to the minimum value Tmin of the necessary access time (Step S113) Subsequently, if the accessible time Ten is more than the minimum value Tmin of the necessary access time, the memory access process described below is performed (Step S114). The reading or the writing process of the information stored in the memory chips of the development portions at the access position is performed to update necessary information. Alternatively, if the accessible time Ten is less than the minimum value Tmin of the necessary access time, the memory access process described below is skipped (Step S114). As described above, it is apparent that the access cannot be finished under the condition and the access is not necessary. The accessible time Ten can be calculated from the process mode to be performed or a size of the image to be formed.

Meanwhile, when the development process performed along with such processes ends (Step S104), an interrupt request for the memory access process is output (Step S105). When the memory access process is not finished at the time of ending the development process, as described in detail below, the performing memory access process is interrupted by the interrupt request.

"The end of the development process" does not mean that the development process of forming all necessary images is not completed, but means that the development process to be successively performed at the time of placing one development portion is completed. When forming the color image, the image forming apparatus allows the development portions to be switched once every rotation of the intermediate transfer belt 71. Accordingly, in the one-image formation process of forming one image on the intermediate transfer belt 71, the end of the development process for one image corresponds to "an end of the development process". Alternatively, in the two-image formation process of forming two images on the intermediate transfer belt 71 corresponds to "the end of the development process". When forming the black-and-while image, the black development portion 4K is positioned at the development position. At this time, since the necessary images are successively formed, the end of the development process for all images corresponds to "the end of the development process".

Subsequently, the above-described process is reiterated for all necessary toner colors (Step S121), and then the necessary image is formed by reiterating the process until all necessary images are obtained (Step S122). At this time, however, since the information of the memory chip on the last used development portion is not updated, the last used development portion is positioned at the access position (Step S123). Subsequently, the memory access process is performed (Step S124), and then the process ends.

Figure 9:
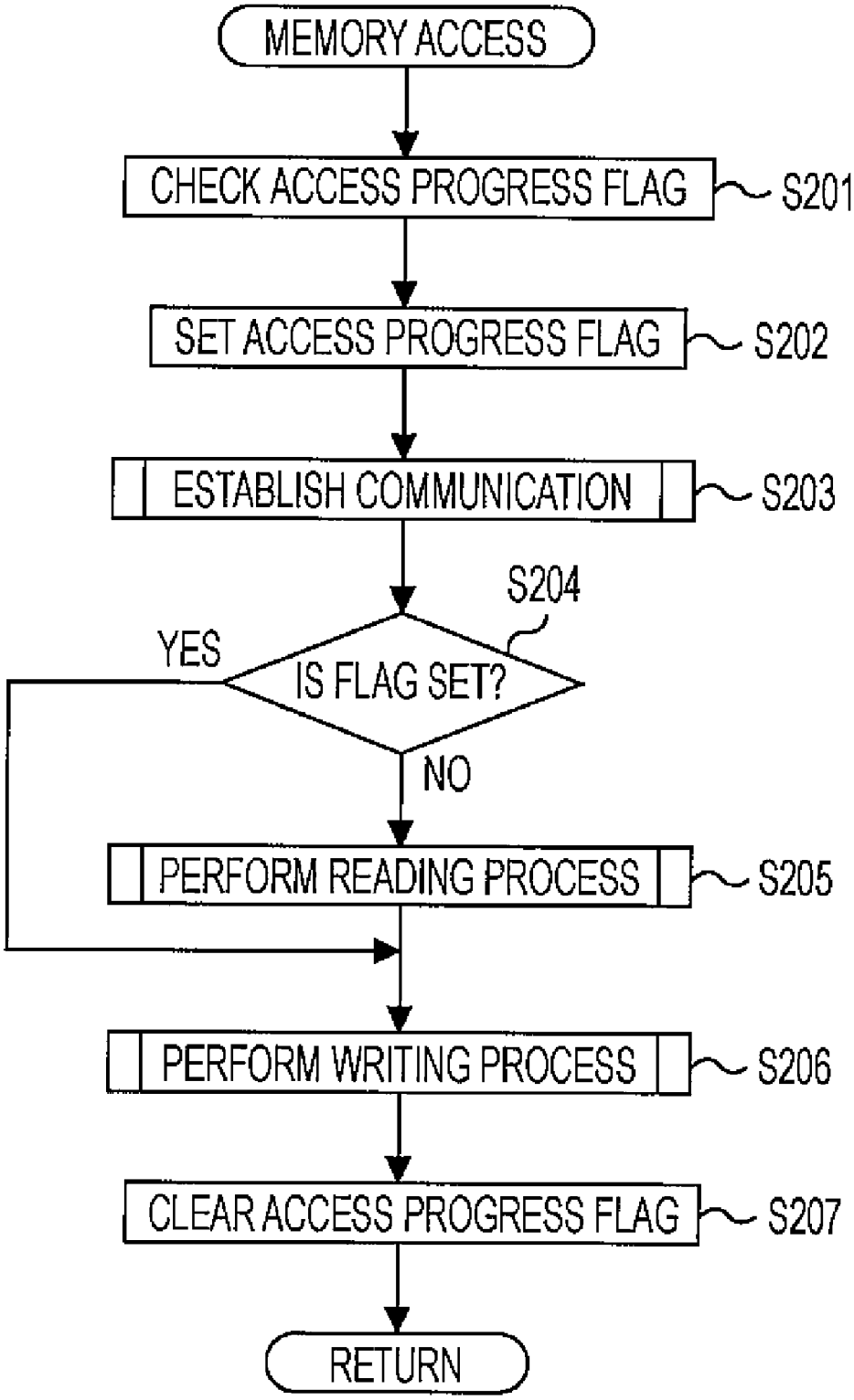
FIG. 9 is a flowchart illustrating a memory access process.

FIG. 9 is a flowchart illustrating the memory access process. When the memory access process starts, the CPU 101 checks an access progress flag, which is one of flags provided in the CPU or the RAM 107, and stores whether the flag is set (Step S201). The access progress flag is separately provided in the toner colors. In Steps S202 and S207 shown in FIG. 9, the access progress flag is set right before the access to the memory chip starts and cleared right after the access ends. That is, while the access progress flag is set, the access to the memory chip starts for the corresponding toner color, but the access does not end. It is desirable to store the flag on a nonvolatile RAM or the like so as to keep the flag even when the image forming apparatus turns off.

Subsequently, the access progress flag is set (Step S202) before the practical access to the memory chip starts. Accordingly, it is possible to confirm the start of the access. In addition, a communication establishment process described below induces the access to the memory chip to start (Step S203).

FIG. 10 is a flowchart illustrating the communication establishment process. The communication establishment process establishes appropriate communication with the apparatus main body before the information stored in the memory chips of the development portions is read or written. First, the access starts by outputting electromagnetic waves for wireless communication from the antenna 109 of the apparatus main body and requesting the response of the memory chip (Step S301), and then the access waits the response of the memory chip. At this time, if there is a normal response of the memory chip, the communication establishment process ends (Step S302).

Alternatively, if there is no response of the memory chip or there is no normal response of the memory chip, the communication establishment process is reiterated until a predetermined number of times (Step S303). When the normal response cannot be received in spite of the reiteration of the predetermined number of times, abnormality is considered to occur in the apparatus main body or the development portions, and thus the access terminates. That is, the access terminates, and the access progress flag is cleared (Step S304). Subsequently, a message for prompting a check of a service man is displayed on a display unit 12. Hereinafter, displaying such a message on the display unit 12 refers to "a service call".

In FIG. 9, the description of the memory access process will continue. When the communication is established in the above-described manner, the process of reading information from the memory chip (Step S205) and the process of writing the information on the memory chip (Step S206) are performed. However, when the access progress flag is set in the flag check of Step S201, the reading process in Step S204 is omitted (Step S204). The reason will be described below.

Figure 12:
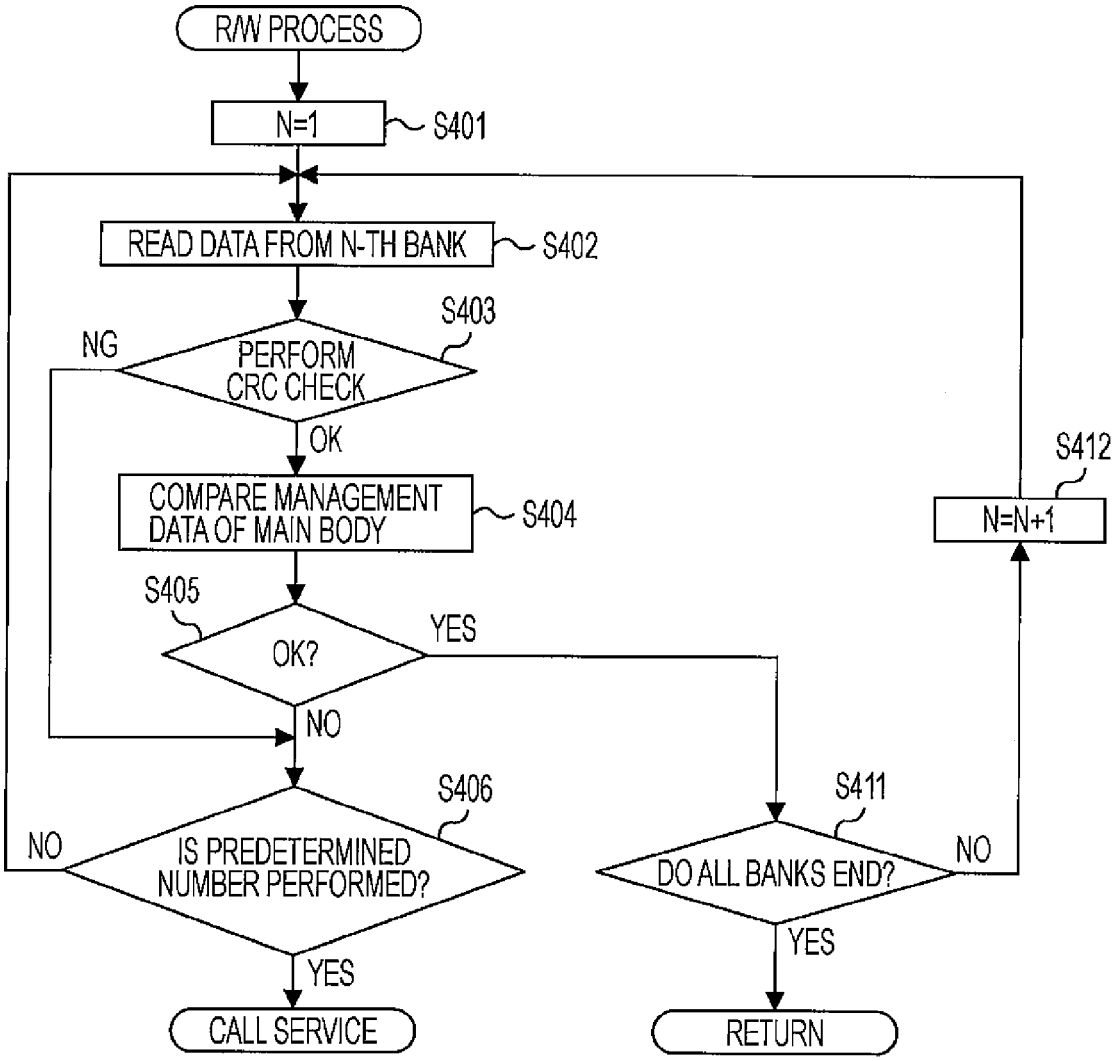
FIG. 12 is a flowchart illustrating a process of reading information from the memory chip.

FIG. 11 is a diagram illustrating a memory map showing information contents of a memory chip. FIG. 12 is a flowchart illustrating a process of reading information from the memory chip. A memory space of each of the memory chips is divided into a plurality of banks. Different types of information are stored in the banks. An information reading and writing process by means of access to the apparatus main body is performed by a bank unit. The information is stored in the memory chips of the development portions and is also backed up in the RAM 107 disposed in the apparatus main body.

Information (identification information of the development portions) required to identify the development portions is stored in a first bank. Specifically, as the identification information of the development portions, a toner color, a manufacture lot No., or the like stored by the corresponding development portion can be used. This information is unique information given at the time of manufacturing the development portions and is not changed when used. Accordingly, this information is read from the memory chips to identify the development portions. However, since this information is not required to update as using the development portions, this information is Just read in the access to the first bank. Only the reading process is necessary in the access to the first bank. In FIG. 11, "R" in "an access type" column means that the corresponding bank is used only for the reading process.

Information (information for a lifetime management) required to manage the lifetime management of the development portions is stored in a second bank. Specifically, as the information on the lifetime management, the total operation time of the development rollers 44 indicating the amount of remaining toner of the corresponding development portion and deterioration of the corresponding development portion can be used. This information is changed as using the development portions. Accordingly, it is desirable to frequently update this information. Because of this, both the reading and writing processes are necessary in the access to the second bank. In FIG. 11, "R/W" in the "access type" column means that the corresponding bank is used for both the reading and writing processes. By storing and managing this types of the information in the apparatus main body as well, and then comparing the information stored in the apparatus main body to that read from the development portions, it is possible to confirm characteristics or the process of the development portions.

Information (information except for the lifetime management) which is changed as using the development portions, but is not directly used in the lifetime management is stored in a third bank. Specifically, as the information except for the lifetime management, the number of detachment from the corresponding development portion, a development setting value, or the like can be used. In addition, information (apparatus main body) on use status of the main body of the image forming apparatus which mounts and operates the corresponding development portion is stored in a fourth bank. As the information on the apparatus main body, for example, the number of forming images, the total operation time, or the like can be used. This information is not directly used in the lifetime management of the development portions. However, by preserving this information in the development portions, for example, the development portions can be determined whether to be re-used on the basis of this information which is stored in the waste development portions recovered from a user. Alternatively, when the image forming apparatus or the development portions are broken down, it can be helpful to find the cause. Both the reading and writing processes are necessary in the access to the third bank for storing the information except for the lifetime management and the fourth bank for storing the information of the apparatus main body.

The process of reading the information from the memory chip configured in the above-described manner is performed below (FIG. 12). First, a bank number N=1 is specified (Step S401), and then the stored data is read from an N-th bank (Step S402). A cyclic code for error detection is given to the data. A cyclic redundancy check (CRC) is performed on the basis of the cyclic code (Step S403). When the check result is OK, that is, there is no error in the read data, the read data is compared to that stored separately in an RAM 107 of the apparatus main body to examine whether both data are identical (Step S404). When there is no abnormality in the image forming apparatus and the previous memory access is appropriately performed, both data are identical. When both data are identical, the reading process to the corresponding bank is considered to be appropriately performed, and then the process ends. The process is reiterated until the process to all the banks ends (Steps S411 and S412). In this way, the information stored in the banks is sequentially read.

The data read from the memory chips and the data of the apparatus main body may accord with each other due to the reasons as follows: the previous access process is not appropriately performed, the development unit 4 does not rotate, or the development portion are switched in an inappropriate manner after the previous access process. In the above-described case and in the case where the CRC result is NG in Step S302, the reading process to the corresponding bank is performed again. In addition, even though the reading process is performed a predetermined number of times, but the CRC result is not OK, it is not desirable to continue the process, and then the service call is performed.

Figure 13:
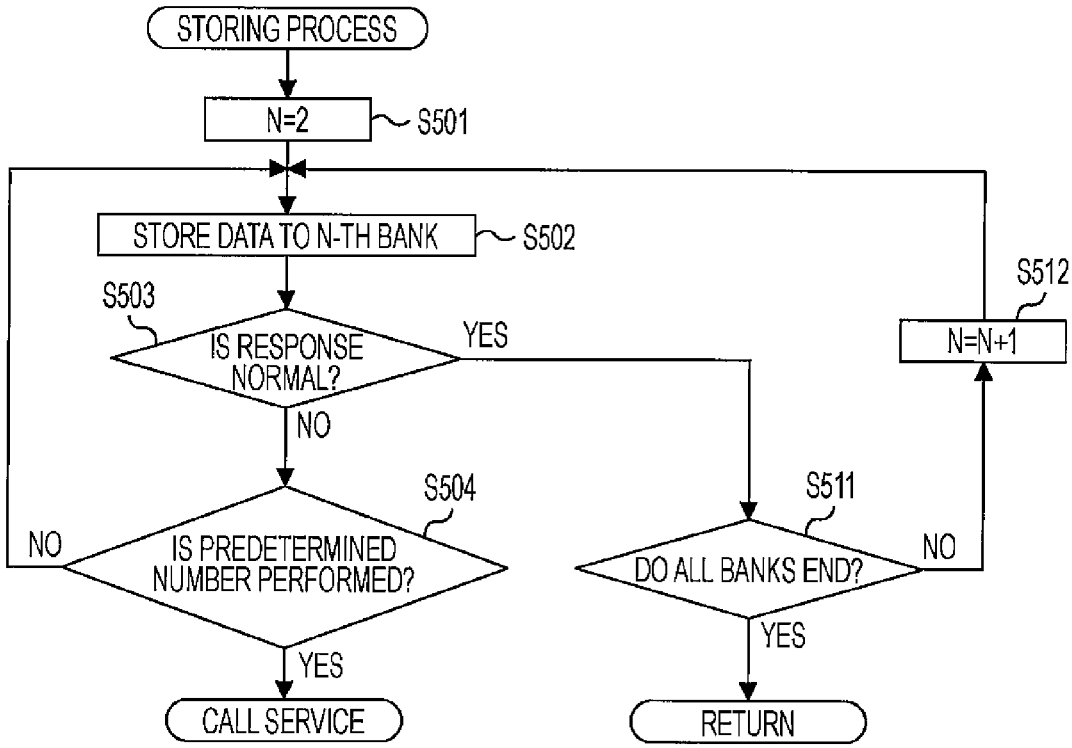
FIG. 13 is a flowchart illustrating a process of writing information on the memory chip.

FIG. 13 is a flowchart illustrating the process of writing information on the memory chip. As described above, the first bank of the memory chip is used only for the reading process. Accordingly, the process of writing the information starts from the second bank by setting N=2 (Step S801). Subsequently, the information is updated by writing new information on the N-th bank (Step S502). After the writing process, the response of the memory chip is confirmed (Step S503). If normal, the process is reiterated until the end of the writing on all necessary banks (Steps S505 and s506). In this way, the information stored in the banks is newly updated. Alternatively, when the normal response of the memory chip cannot be received, the writing process is performed again. Even when the writing process cannot be normally performed by a predetermined number of times, the service call is performed (Step S504).

In FIG. 9, the description of the memory access process will continue. When the reading process (Step S205) and the process of writing the information on the memory chip (Step S206) end in the above-described manner, the access progress flag is cleared (Step S207), and then the memory access process ends.

However, in the memory access process, reception of the interrupt request (see FIG. 8) output at the time of finishing the development process is allowed. When the interrupt request occurs during the memory access process, an interrupt process described below is performed, and then the following memory access process stops.

Figure 14:
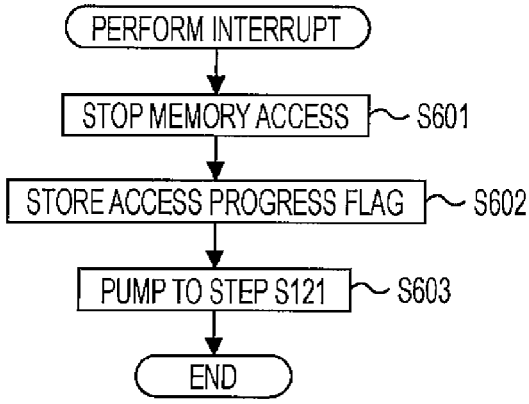
FIG. 14 is a flowchart illustrating an interrupt process.

FIG. 14 is a flowchart illustrating the interrupt process. When the interrupt request is received during the memory access process, the interrupt process is performed. First, the performing memory access process stops (Step S601), the access progress flag is stored at that time (Step S602), and then the present step jumps to Step S121 of the image formation process shown in FIG. 8 (Step S603). In the apparatus, the rotation of the rotary development unit 4 induces the switching of the development portions. That is, in the embodiment, when the development process ends, the memory access process performed at that time stops, and then the switching of the development portions is performed. In this way, in the embodiment, after the image formation, the development portions are switched at the quick timing, thereby improving image quality.

As described above, the access progress flag is set during the memory access progress. Accordingly, when the access does not end at the time of receiving the interrupt request, the memory access process stops with the access progress flag set. In other words, when the memory access to one development portion is not in progress, but the access progress flag is set, the memory access process to the one development portion beforehand does not end.

When the memory access process does not end, but the development portions are switched, the information stored in the memory chip may be damaged or may not be updated. Accordingly, the information is not appropriate information.

In the memory access process according to the embodiment, as shown in FIG. 9, the flag indicating that the memory access process is in progress is provided. In addition, when the access progress flag is already set at the time of starting the memory access progress, the reading process is not performed and only the writing process is performed to update new information. In this way, the above-described method is used to prevent the inappropriate process from being performed. One example of the inappropriate process includes a case where the development portions are determined whether to be appropriately performed on the basis of the wrong information. Accordingly, when the memory access process ends or when the development unit 4 starts the rotation before the end of the memory access process, it is possible to appropriately perform the lifetime management of the development portions. In other words, since the memory access process is configured in the above-described manner, it is possible to switch the development portions without waiting the end of the memory access. In the processes shown in FIG. 9, when the access progress flag is set, the reading process is not performed because of the above-described reason.

Figure 15:
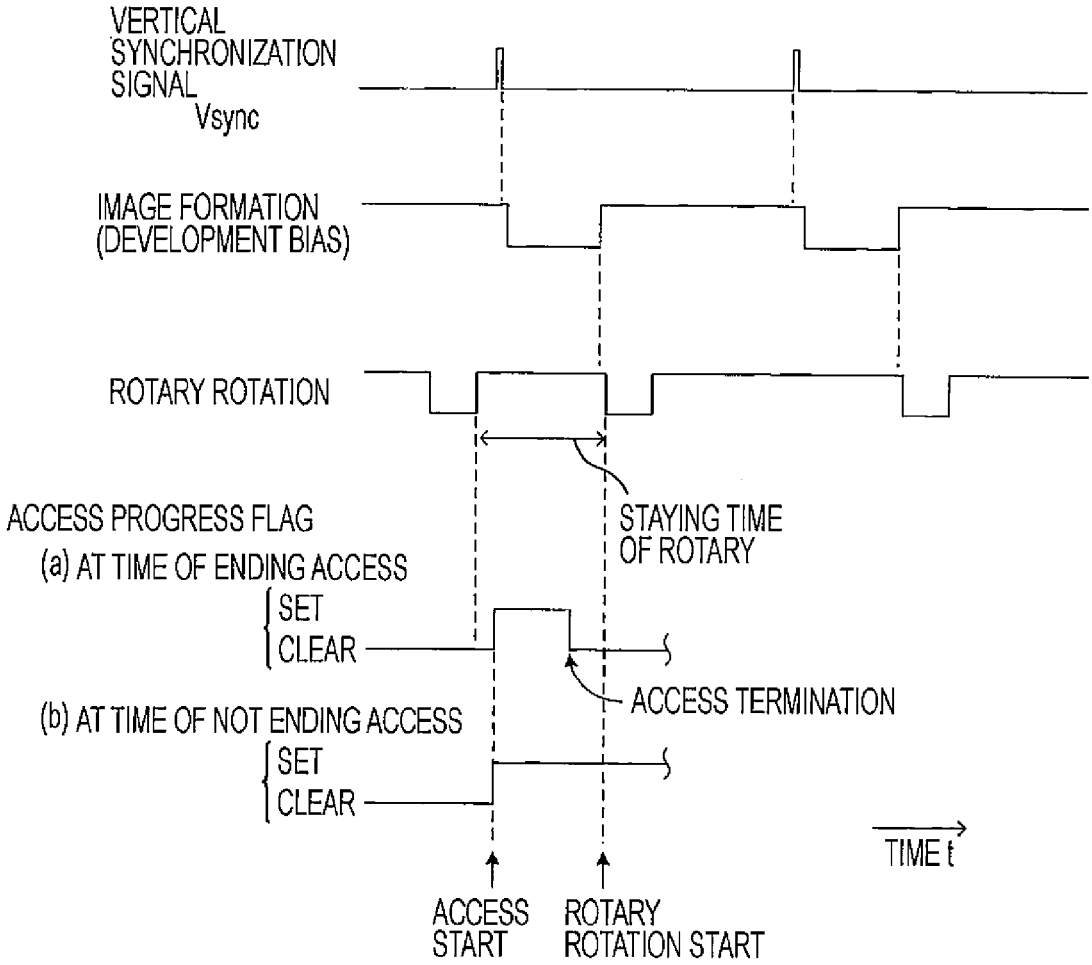
FIG. 15 is a diagram illustrating variation of a flag during access according to the embodiment.

FIG. 15 is a diagram illustrating variation of the flag during access according to the embodiment. As shown in FIG. 15, the access progress flag is set when the rotary development unit 4 stops and the access from the apparatus main body to the memory chip starts. As shown in FIG. 15, when the access ends during the rotary staying period of time, the access progress flag is cleared at that time. Alternatively, as shown in FIG. 15, when the development unit 4 starts the rotation before the end of the access, the access progress flag is in the set state. The state continues until the next access to the corresponding development portion and the access type can be changed in accordance with the flag state in the next access. Accordingly, when the previous access ends or does not end, it is possible to appropriately update the information in the next access.

As described, in the embodiment, the access to the memory chips of the development portions is configured to be performed again by the predetermined number of times when the communication establishment process fails. Accordingly, compared to the case where the communication establishment process is not performed again, it is possible to considerably improve success probability of the process of reading or writing information.

According to the embodiment, there is provided the access progress flag indicating that the memory access is in progress. Accordingly, whether the previous access ends or not is determined on the basis of the flag state. In addition, when the access progress flag is set at the time of starting the memory access process again, the previous access does not end. At this time, the information is updated as new information by overwriting the information managed in the apparatus main body on the memory chip to record the information without using the information stored in the memory chip at that time. Accordingly, even when development unit 4 rotates before the end of the memory access process, the lifetime management of the development portions is not affected. Moreover, since the development unit 4 can rotate without waiting the end of the memory access process, it is possible to switch the development portions at the quick timing right after the end of the development process, thereby improving the image quality.

If the access progress flag is not set at the time of starting memory access process, it is shown that the previous access ends. The identification of the development portions is determined by comparing the information read in the new access to the information stored in the PAM 107 of the apparatus main body. Accordingly, it is possible to deal with erroneous switching of the development portions or breakdown of the development unit 4 or the development portions.

As described above, the development portions 4Y, 4M, 4C, and 4K serve as "development portions" according to the invention. The development unit 4 holding and rotating the development portions serves as "a development unit holder" according to the invention. In the embodiments, the engine controller 10 including the CPU 101 serves as "a controller" according to the invention. The transceiver 105 and the antenna 109 serve together as "an access unit" according to the invention. The memory chips 491Y, 491M, 491C, and 491K of the development portions serve as "a memory" according to the invention. In addition, the access progress flag according to the embodiment corresponds to "the non-end indicator" according to the invention.

The invention is not limited to the above-described embodiment, but may be modified to various forms without departing from the gist of the invention. For example, in the embodiment, the information stored in the memory chips of the development portions is shown in FIG. 11, but the information is just one example of the information. Accordingly, the information to be stored in the memory chip is not limited thereto.

In the embodiment, as shown in FIG. 8, the time Ten the development portions stops at the access position to access the memory chip can be less than the minimum access time Tmin. At this time, the memory access process is configured not to be performed, but the following process can be performed.

Figure 16:
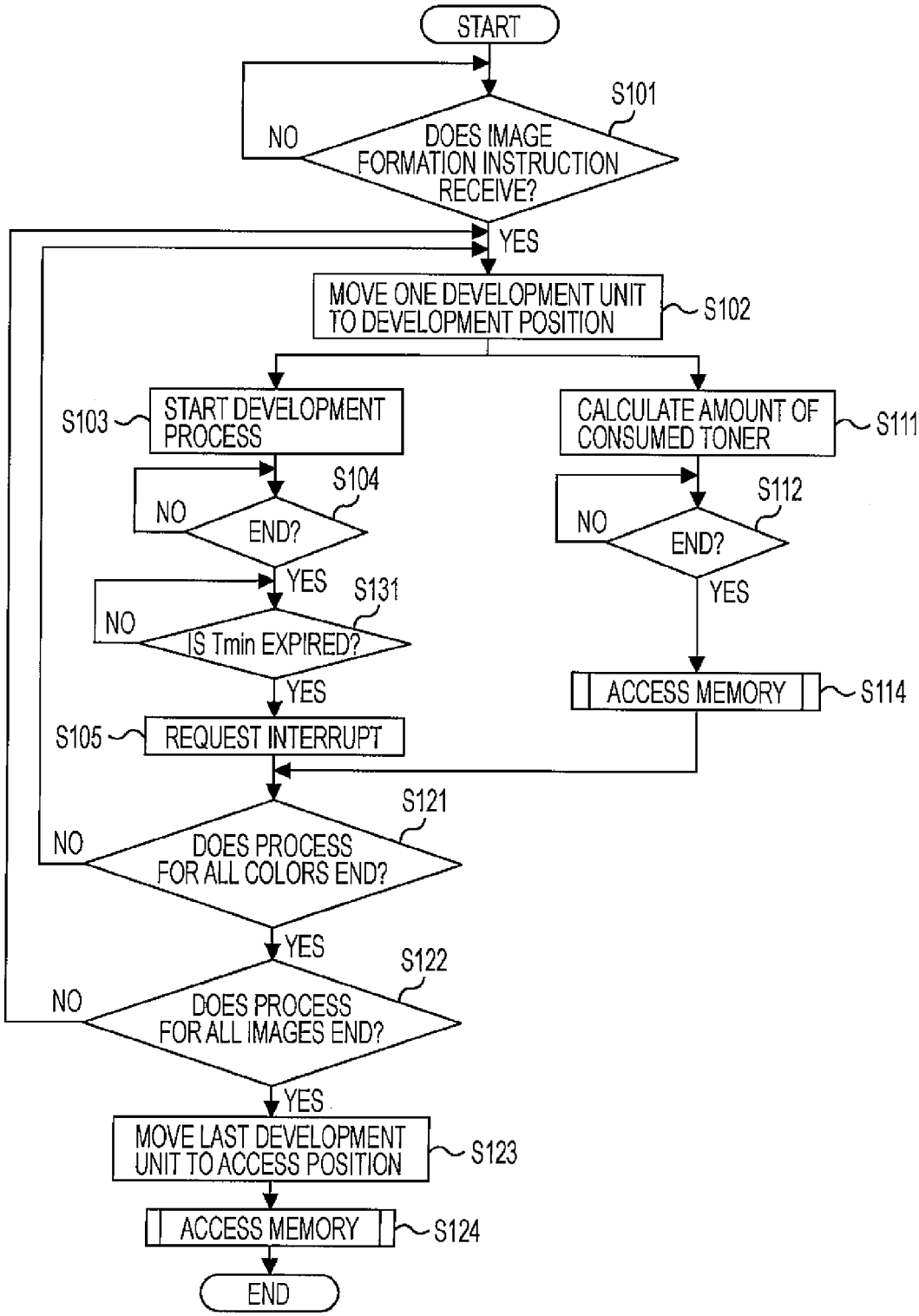
FIG. 16 is a flowchart illustrating an image forming process according to another embodiment.

FIG. 16 is a flowchart illustrating the image forming process according to another embodiment. Since parts of the image forming process shown in FIG. 8 are modified, the same step numerals are given to the same step. The image forming process is different from that shown in FIG. 8 in that Step S113 is omitted and new Step S131 between Steps S104 and S105 is provided. By modifying in the above-described manner, the image forming process is modified as follows. First, since Step S113 is omitted, the memory access process is normally performed irrespective of the stationary time of each of the development portions.

Meanwhile, in newly provided Step S131, it is waited until the minimum access time Tmin passes in consideration of time when the calculation of the amount of consumed toner ends in Step 111. Accordingly, even when the development process ends quickly, the interrupt request in Step S105 is not output until the calculation of the amount of consumed toner ends, and then the minimum access time Tmin passes. That is, time when the interrupt request is output to switch the development portions is time the calculation of the amount of consumed toner ends, and then the minimum access time Tmin passes at least. Accordingly, in the memory access process, time required to finish the process without the retry is normally provided. In the example, time when the access does not end is just a case where the stationary time of the development unit 4 is shorter and it takes time to perform the access again. Accordingly, in many cases, it is possible to end the memory access process.

In the above-described embodiment, when the previous access does not end by the access progress flag, the process of reading the information from the memory chips of the development portions is configured to be omitted. That is because of avoiding the case where the process is performed on the basis of the wrong information. As a result, it is possible to prevent reliability of the written information from being deteriorated. Moreover, the process may be performed as follows.

As shown in FIG. 11, the identification information stored in the first bank of the memory chip is used only for the reading process. That is, the information is fixed at the manufacturing time, and thus it is not necessary to change the information. Accordingly, even when the access does not end, the reliability of the information is not deteriorated. In the memory access process, the reading process is not completely skipped, but at least the information stored in the first bank is read. In addition, the determination based on the information is made. For example, when the toner color or the manufacturing lot No. shown in the information read from the first bank are identical with the information managed in the apparatus main body, it may be determined that the development portions are the same as the previous access target. In addition, when the information such as a serial No. used to identify the development portions is included, it is possible to identify the corresponding development portion on the basis of the information.

In the above-described embodiment, the wireless communication is carried out through the wireless communication antennas disposed in the apparatus main body and the development portions, but the invention is not limited thereto. For example, even when connectors are mechanically connected to each other via communication lines to carry out the communication, the invention is appropriately applicable.

In the above-described embodiment, when the calculation of the amount of remaining toner to be written to the memories is finished, the accessible time is calculated. However, the calculation is performed since time when the amount of remaining toner is calculated is later than the time the development portions stop. In addition, when the calculation ends at the time the development portions stop, the accessible time can be calculated from the stationary time of the development portions.

Moreover, in the above-described embodiments, there is provided the image forming apparatus capable of forming the color image on the intermediate transfer belt using the four-color toner. However, the invention is not limited to the number or types of the toner. Instead of the intermediate transfer belt, another intermediate transfer member such as an intermediate transfer drum may be provided. In addition, the invention is applicable to an apparatus configured to overlap a toner image on a photosensitive member or a print material without providing the intermediate transfer member.

What is claimed is:

1. An image forming apparatus comprising:

a development portion holder that is mounted with a plurality of development portions, each having a memory storing information thereof and that selectively positions the development portions at a development position by holding and moving the mounted development portions;

a controller that controls the development portion holder and that performs an image forming process of forming an image using the development portion positioned at the development position; and an access unit that access the memory of the development portion positioned at an access position, which is a position at which one of the other development portions mounted on the development portion holder is located, to read and record the information when one of the development portions mounted on the development portion holder is positioned at the development position, wherein when the access unit is accessing the memory at the time of an image formation of the development portion positioned at the development position in the image forming process, the controller controls the development portion holder to stop the access and to start the switching of the development portions in a state where a non-end indicator indicating that the access has not ended is recorded, and wherein when the access unit is not accessing the memory, the controller controls the development portion holder to start the switching of the development portions in a state where the non-end indicator is not recorded.

2. The image forming apparatus according to claim 1, wherein the non-end indicator is provided to correspond to the plurality of development portions that can be mounted on the development portion holder.

3. The image forming apparatus according to claim 1, wherein an access type of the access unit to the memory is changed depending on whether the non-end indicator is recorded right before starting the access.

4. The image forming apparatus according to claim 3, wherein the access unit performs an access process including processes of reading information from the memory and recording information on the memory when the non-end indicator is not recorded right before starting the access, and performs an access process not including a process of reading information from the memory but including a process of recording information on the memory when the non-end indicator is recorded right before starting the access.

5. The image forming apparatus according to claim 1, wherein the controller changes a process type based on the information read from the memory, depending on whether the non-end indicator is recorded right before the access unit starts the access to the memory.

6. The image forming apparatus according to claim 5, wherein the information stored in the memory includes variation information that varies with the use of the corresponding development portion, wherein the controller includes an information holder that temporarily holds at least a part of the variation information recorded in the memory by the access unit, and wherein the controller judges the identification of the development portion by comparing the variation information read from the memory and the variation information held in the information holder when the non-end indicator is not recorded right before starting the access of the access unit, and does not judge the identification based on the variation information when the non-end indicator is recorded.

7. The image forming apparatus according to claim 1, wherein the non-end indicator is a flag that is set at the time of starting the access of the access unit to the memory and that is cleared at the time of ending the access.

8. An image forming method of performing an image forming process of selectively positioning a plurality of development portions at a predetermined development position, forming an image by the use of the development portion positioned at the predetermined development position, and accessing a memory of the development portion positioned at an access position other than the development position to read or record information on the development portion, the image forming method comprising:

ending the access and starting the switching of the development portions in a state where a non-end indicator indicating that the access has not ended is recorded, when the access to the memory is being performed at the time of ending an image formation of the development portion positioned at the development position in the image forming process; and starting the switching of the development portions in a state where the non-end indicator is not recorded, when the access to the memory is not being performed.

* * * * *